US005508247A

United States Patent [19]

Tran et al.

[11] Patent Number: 5,508,247

[45] Date of Patent: Apr. 16, 1996

[54] LINERLESS DIRECT THERMAL LABEL

[75] Inventors: Steve Tran, Tustin; Minh Ly, Westminster; Kelly Morse, Huntington Beach, all of Calif.

[73] Assignee: Ricoh Electronics, Inc., Santa Ana, Calif.

[21] Appl. No.: 312,276

[22] Filed: Sep. 26, 1994

[51] Int. Cl.[6] ..... B41M 5/40

[52] U.S. Cl. ..... 503/200; 427/152; 503/226

[58] Field of Search ..... 427/152; 503/200, 503/226

[56] References Cited

U.S. PATENT DOCUMENTS

| | | | |
|---|---|---|---|
| 4,288,496 | 9/1981 | Reusser et al. | 428/447 |
| 4,525,566 | 6/1985 | Homan et al. | 528/17 |
| 4,720,479 | 1/1988 | Craig et al. | 503/200 |
| 4,851,383 | 7/1989 | Fickenscher et al. | 503/200 |
| 5,021,110 | 6/1991 | Kobayashi | 156/299 |
| 5,021,273 | 6/1991 | Kobayashi | 428/40 |
| 5,275,855 | 1/1994 | Kobayashi et al. | 428/40 |
| 5,292,713 | 3/1994 | Stenzel et al. | 503/226 |

FOREIGN PATENT DOCUMENTS

| | | | |
|---|---|---|---|
| 59-107264 | 7/1984 | Japan | 503/226 |
| 59-179071 | 11/1984 | Japan | 503/226 |
| 0054842 | 3/1985 | Japan | 503/226 |

*Primary Examiner*—B. Hamilton Hess
*Attorney, Agent, or Firm*—Walter A. Hackler

[57] ABSTRACT

A linerless thermal label is produced by disposing a thermosensitive layer into a substrate and allowing the thermosensitive layer to dry, said thermosensitive layer comprising a color former causing the thermosensitive layer to remain color stable. A protective layer is applied on top of the thermosensitive layer and exposes the protective layer to a temperature and a time sufficient to dry the protective layer but not cause the thermosensitive layer to a change color. A heat curable silicone mixture is disposed on said protective layer and thereafter cured to form a release layer without causing color change in the thermosensitive layer. A pressure-sensitive adhesive is applied on an opposite side of the substrate which is exposed to a temperature for a time sufficient to dry the pressure-sensitive adhesive without causing color change in the thermosensitive layer, and the substrate is then rolled in a manner causing the pressure-sensitive adhesive to contact the release layer.

10 Claims, 1 Drawing Sheet

LINERLESS DIRECT THERMAL LABEL

The present invention generally relates to thermosensitive recording labels and is more particularly directed to linerless thermosensitive recording labels.

Linerless labels, as described in U.S. Pat. Nos. 4,851,383 and 5,292,713, eliminate the use of a backing sheet in order to effectively double the number of usable labels that can be stored on a given roll, or stack, of labels.

Problems associated in the manufacture of such labels are described in the hereinabove referenced patents. In addition to the enumerated problems set forth in the referenced patents, further problems are incurred if a heat curable silicone release layer is to be utilized in view of the heat sensitivity of the thermosensitive layer.

The present invention provides for a linerless thermal label utilizing a heat curable silicone release layer.

SUMMARY OF THE INVENTION

In accordance with the present invention, a linerless thermal label is produced by a method comprising the steps of disposing a thermosensitive layer onto a substrate and allowing the thermosensitive layer to dry. The thermosensitive layer may comprise a colorformer causing the thermosensitive layer to remain color stable at temperatures up to about 90° C. for at least about 10 seconds.

Thereafter, a protective layer is provided on top of the thermosensitive layer and exposed to a temperature for a time sufficient to dry the protective layer but not heat the thermosensitive layer to a temperature over about 90° C. for more than about 10 seconds.

A heat curable silicone mixture is then disposed on the protective layer and thereafter exposed to a temperature between about 60° C. and about 130° C. for sufficient time to cure the silicone mixture without causing color change to the thermosensitive layer, to form a release layer.

A pressure sensitive adhesive is then applied on an opposite side of the substrate and exposed to a temperature of between about 70° C. and about 150° C. for a time sufficient to dry the pressure sensitive adhesive without causing color change to the thermosensitive layer.

Finally, the substrate is rolled in a manner causing the pressure sensitive adhesive to contact the release layer.

More particularly, the linerless thermal label produced in accordance with the method of the present invention includes the step of applying the protective layer to a thermosensitive layer with a dried thickness suitable for providing heat insulation of the thermosensitive layer from subsequent exposure to the silicone mixture to a curing temperature.

More particularly, the linerless thermal label produced in accordance with the method of the present invention includes the step of disposing a thermosensitive layer with a colorformer comprising a leuco dye system to the substrate and a protective layer comprising of an inorganic filler on the top of the thermosensitive layer.

Preferably, the method in accordance with the present invention comprises disposing the protective layer on top of the thermosensitive layer with a thickness of between about 3 and about 10 microns.

The method in accordance with the present invention for producing a linerless thermal label further comprises the step of disposing the curable silicone mixture comprising a water base compatible emulsion silicone polymer and a catalyst.

More particularly, the water base compatible emulsion silicone may be applied in a protective layer with a coated weight of between about 1 $g/m^2$ and about 7 $g/m^2$ dry weight.

Alternatively, a method in accordance with the present invention for producing a linerless label may include disposing a non-water compatible heat curable silicone mixture on the protective layer in an amount to cause a coating weight of between about 0.2 $g/m^2$ to about 1.2 $g/m^2$ dry weight.

BRIEF DESCRIPTION OF THE DRAWINGS

A better understanding of the present invention may be had from consideration of the following detailed description, taken in conjunction with the accompanying drawings in which.

DETAILED DESCRIPTION

Figure 1:
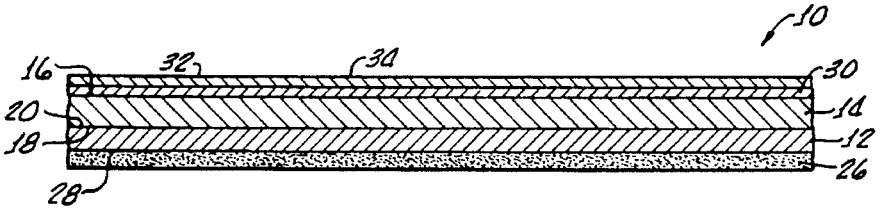
FIG. 1 is a cross-sectional view of a linear thermal label in accordance with the present invention generally showing each of the layers therein.

Turning now to FIG. 1, the linerless thermal label produced in accordance with the present invention generally includes a substrate 12 in a thermosensitive layer 14 having a top surface 16 and a bottom surface 18. The thermosensitive layer 14 is disposed on one side 20 of the substrate 12, with the bottom surface 18 in contact therewith.

A layer 26 and pressure sensitive adhesive is disposed on an opposite side 28 of the substrate 12 and silicone layer 32 is disposed on a barrier layer 30 covering the thermosensitive layer top surface 16. As will be described hereinafter in greater detail, the silicone layer 32 may be a mixture of silicone polymer, cross-linked in a catalyst or an emulsion silicone polymer and a catalyst which are compatible with water. Both of these silicone mixtures are heat curable and the curing thereof, as will be described hereafter in greater detail, is accomplished without causing color formation in the thermosensitive layer.

The silicon layer 32 is capable of being placed in contact and thereafter separated from the pressure sensitive adhesive layer 26 without significant damage to the thermosensitive layer 14.

Generally, the substrate 12 may be a high quality paper, or the like, and the thermosensitive layer 14 may be any suitable color-forming system, such as a leuco dye system, or a metallic dye system, both of which are well-known in the art.

For example, a suitable leuco dye system is described in U.S. Pat. Nos. 4,370,370 and 4,388,362, the latter being incorporated herein by specific reference thereto for showing, with U.S. Pat. No. 4,370,370 examples of the colorless or light-colored leuco dye systems typical of the art.

Additional components in the leuco dye system may be utilized, as is well-known in the art, with such components being identified as color enhancers and binders and the like.

The pressure sensitive adhesive 26 may be of any suitable type such as, for example, an acrylic emulsion/heat melt available from National Starch and Chemical Corporation, which when applied at a density of between about 10 $g/m^2$ to about 25 $g/m^2$ will dry in about 5 to about 15 seconds when exposed to a temperature between about 70° C. and about 150° C.

The barrier layer 30 may be a water soluble resin solution coated on the thermosensitive layer 14 and thereafter dried. A number of water soluble resins may be utilized at the barrier layer 30, such as, for example, polyvinyl alcohol, available from Air Products Corporation.

Importantly, when applied at a density between about 0.0025 $g/cm^2$ and about 0.0045 $g/cm^2$ the protective layer provides heat insulation of the thermosensitive layer 14 from subsequent exposure to the silicone mixture to a curing temperature.

In that regard, the thermosensitive layer includes a colorformer which enables the thermosensitive layer to remain color stable at exposure temperatures of up to 90° C. for at least 10 seconds, color stability meaning that the thermosensitive layer does not change its background color during the production process.

The silicone layer also comes in combination with a barrier layer, protects the thermosensitive layer 14 from damage by the pressure sensitive adhesive 26 when the label 10 is wound into a roll 40 with the silicone layer 32 being thereby placed in contact with the pressure sensitive adhesive 26.

Figure 2:
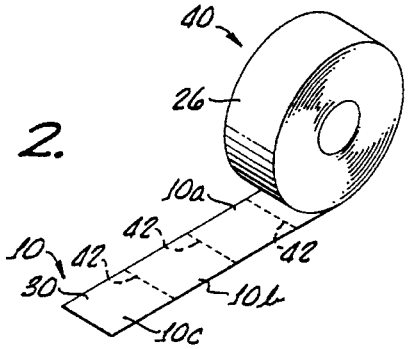
FIG. 2 is a perspective view of a plurality of linerless thermal labels rolled for compact storage and illustrating perforations in the substrate layer of the label which enables separation thereof into separated individual thermosensitive, pressure sensitive labels.

As indicated in FIG. 2, the substrate 12, as well as all of the other layers, of the present label may be perforated, as shown by the dotted lines 42, to enable the pressure sensitive label 10 to be separated into individual labels 10A, 10B and 10C.

Figure 3:
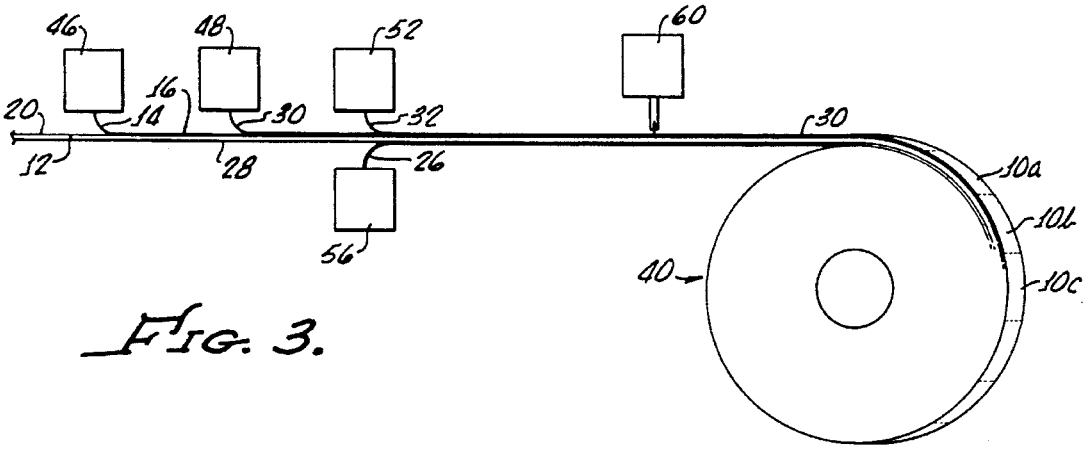
FIG. 3 is a diagram illustrating the method of manufacture of the linerless thermal label in accordance with the present invention.

Turning now to FIG. 3, there is illustrated a method for producing a linerless thermal label in accordance with the present invention.

A thermosensitive layer 14 is deposited on the one side 20 of the substrate 12 by any suitable apparatus 46. Thereafter, the substrate 12 is moved to another position in which the barrier layer 30 is applied on the top surface 16 of the thermosensitive layer 14 by means of apparatus 48 in a conventional manner. After drying the barrier layer by exposure to temperature of up to 100° C., the silicone layer 30 is deposited onto the barrier layer by conventional apparatus 52, such as used in the knife-over-roll method. Thereafter, the silicone layer is exposed to a temperature between about 60° C. and about 130° C. for sufficient time to cure the silicone layer without causing color change in the thermosensitive layer 14.

On the opposite side 28 of the substrate, the pressure-sensitive adhesive 26 is deposited by conventional apparatus 56. The application of the pressure-sensitive adhesive 26 to the opposite side 28 of the substrate 12 may occur at any time relative to the application of the colorforming layer. In addition, because the colorforming layer is color stable to the production temperatures, it should be appreciated that any suitable order of application of the layers comprising the linerless thermal labels is in accordance with the present invention.

Finally, the substrate, with the thermosensitive layer 14, pressure-sensitive adhesive 26, barrier layer 30 and silicone layer 32 thereon may be rolled to form a roll 40 with separate labels 10A, 10B, 10C with the pressure-sensitive adhesive 26 in contact with the silicone layer 32 on the top surface 20 of the colorforming layer 14.

The following examples are presented by way of illustration only, and not to be considered as limiting the present invention.

EXAMPLE 1

A colorformer solution including a leuco dryer and a phenol compound was prepared as follows:

| | Parts by wt. |
|---|---|
| Dispersion A: | |
| 4 Hydroxy-4'-isopropoxy-diphenyl sulfone | 8.10 |
| Polyvinyl alcohol (10% aqueous solution) | 8.10 |
| Water | 33.80 |
| Dispersion B: | |
| 2-anilino-methyl-6-dibutylamino fluorane | 10.00 |
| Polyvinyl alcohol (10% aqueous solution) | 10.00 |
| Water | 30.00 |

Thereafter, a barrier or top coat solution, which contains a filler, a polymer alcohol and a cross-linker was prepared as follows:

| | Part by wt. |
|---|---|
| $Al_2O_3 3H_2O$ | 2.33 |
| Polyvinyl Alcohol | 20.88 |
| Polyamide resin | 3.36 |
| Water | 23.43 |

A paper substrate was prepared for coating as follows:

The prepared Dispersant A and Dispersant B were mixed to form a thermosensitive coloring liquid and the prepared top coat solution was ready to coat onto the substrate.

A colorformer solution, as hereinabove described, was then applied to the substrate and allowed to dry. Thereafter, the barrier, or protective top coat solution, was applied to the top of the thermosensitive layer and exposed to heat of up to about 160° C., the protective layer being applied to a density of about 1.5 $g/m^2$ to about 4.5 $g/m^2$.

A silicone mixture comprising a silicone polymer, cross-linker and catalyst, such as SYL-OFF 7600, obtained from Dow Corning Corporation, was applied to the top of the protective layer at between about 0.2 to about 1.2 $g/m^2$ and dried at a temperature between about 60° C. to about 120° C. for a period of about 10 seconds.

A pressure-sensitive adhesive such as G-60, acrylic emulsion adhesive, obtainable from National Starch and Chemicals, Inc., was disposed on an opposite side of the substrate and exposed in a dryer at a temperature between 70° C. to about 150° C. Thereafter, the substrate was rolled onto itself in a way that the pressure-sensitive adhesive contacts the silicone layer on top of the protective layer.

EXAMPLE 2

A sample was prepared in a manner identical to that set forth in Example 1, except that a silicone mixture which contains an emulsion silicone polymer in its catalyst, which is compatible with other water-based systems, such as SYL-OFF, and available through Dow Corning and/or General Electric, was disposed on top of the protective layer with a coating weight of about 3 g/m$^2$ to about 7 g/m$^2$ dried weight and then exposed to a temperature in a dryer between about 70° and 150° C. to cure. During production of the labels as set forth in Examples 1 and 2, no discoloration of the thermal layer was observed due to the selection of the colorformer.

Although there has been hereinabove described a method for producing linerless thermal label in accordance with the present invention, for the purpose of illustrating the manner in which the invention may be used to advantage, it should be appreciated that the invention is not limited thereto. Accordingly, any and all modifications, variations, or equivalent arrangements which may occur to those skilled in the art, should be considered to be within the scope of the present invention as defined in the appended claims.

What is claimed is:

1. A linerless thermal label produced by a method comprising the steps of:

disposing a thermosensitive layer onto one side of a substrate having an opposite side, and allowing the thermosensitive layer to dry, said thermosensitive layer comprising a color former causing the thermosensitive layer to remain color stable at a temperature up to about 90° C. for at least about 10 minutes;

applying a protective layer on top of the thermosensitive layer and exposing the protective layer to a temperature and a time sufficient to dry the protective layer but not heat the thermosensitive layer to a temperature over about 90° C. for more than about 10 seconds;

disposing a heat curable silicone mixture on said protective layer and thereafter exposing the silicone mixture to a temperature of between about 60° C. and about 130° C. for sufficient time to cure the silicone mixture without causing color change in the thermosensitive layer to form a release layer;

applying a pressure-sensitive adhesive onto the opposite side of the substrate and exposing the pressure-sensitive adhesive to a temperature of between about 70° C. and about 150° C. for a time sufficient to dry the pressure-sensitive adhesive without causing color change in the thermosensitive layer; and rolling the substrate in a manner causing the pressure-sensitive adhesive to contact the release layer.

2. The linerless thermal label produced in accordance with claim 1, wherein the method further comprises the step of applying the protective layer to the thermosensitive layer with a dried thickness suitable for providing heat insulation of the thermosensitive layer from subsequent exposure of the silicone mixture to a curing temperature.

3. The linerless thermal label produced in accordance with claim 2 wherein the method further comprises disposing the thermosensitive layer with a colorformer comprising a leuco dye and an acidic substance to the substrate.

4. The linerless thermal label produced in accordance with claim 3 wherein the method further comprises disposing the protective layer comprising an inorganic filler on top of the thermosensitive layer.

5. The linerless thermal label produced in accordance with claim 4 wherein the method further comprises disposing the protective layer on top of the thermosensitive layer with a thickness of between about 1 micron and about 10 microns.

6. The linerless thermal label produced in accordance with claim 5 wherein the method further comprises disposing the heat curable silicone material comprising polydimethyl siloxane on said protective layer.

7. The linerless thermal label produced in accordance with claim 6 wherein the method further comprises disposing the heat curable silicone mixture comprising a water base-compatible emulsion silicon polymer and a catalyst on said protective layer.

8. The linerless thermal label produced in accordance with claim 7 wherein the method further comprises disposing the non-water compatible heat curable silicone mixture on said protective layer.

9. The linerless thermal label produced in accordance with claim 8 wherein the method further comprises disposing the heat curable silicone mixture on said protective layer with a coating weight of between about 0.2 g/m$^2$ to about 1.2 g/m$^2$ dried weight.

10. The linerless thermal label produced in accordance with claim 6 wherein the method further comprises disposing the heat curable silicone mixture on said protective layer with a coating weight between about 0.5 g/m$^2$ and about 3.5 g/m$^2$ direct weight.

* * * * *